US006481613B1

(12) United States Patent
Tebo

(10) Patent No.: US 6,481,613 B1
(45) Date of Patent: Nov. 19, 2002

(54) FASTENER DRIVING DEVICE

(76) Inventor: Glenn J. Tebo, P.O. Box 754, Kingston, NH (US) 03848

( * ) Notice: Subject to any disclaimer, the term of this patent is extended or adjusted under 35 U.S.C. 154(b) by 0 days.

(21) Appl. No.: 09/505,118

(22) Filed: Feb. 16, 2000

(51) Int. Cl.[7] ..... B25C 1/04
(52) U.S. Cl. ..... 227/147; 227/148; 227/156
(58) Field of Search ..... 227/147, 148, 227/150, 139, 110, 156, 119

(56) References Cited

U.S. PATENT DOCUMENTS

| | | | | |
|---|---|---|---|---|
| 310,678 | A | 1/1885 | Halstrom | 411/470 |
| 317,304 | A | 5/1885 | Condit, Jr. | 411/458 |
| 327,537 | A | 10/1885 | Dodsworth | 227/139 |
| 642,377 | A | 1/1900 | Smith | 411/459 |
| 712,569 | A | 11/1902 | Myers | 411/458 |
| 847,888 | A | 3/1907 | Birdsall | 411/459 |
| 989,198 | A | 4/1911 | Slayton | 411/458 |
| 1,074,800 | A | 10/1913 | King | 227/139 |
| 1,186,383 | A | 6/1916 | Danly | 411/458 |
| 1,390,918 | A | 7/1921 | McFarland | 411/458 |
| 1,510,360 | A | 9/1924 | Van Rijmenam | 411/457 |
| 2,079,194 | A | 5/1937 | Williams | 411/458 |
| 2,169,433 | A | 8/1939 | Roy | 227/147 |
| 2,199,833 | A | 5/1940 | Fleischman | 227/147 |
| 2,270,284 | A | 1/1942 | Faggard | 411/473 |
| 2,620,705 | A | 12/1952 | Podvinecz et al. | 411/460 |
| 2,845,103 | A | 7/1958 | Sypher | 227/147 |
| 2,994,878 | A | 8/1961 | Abrahamsen | 227/147 |
| 3,022,509 | A | 2/1962 | Tjark de Man | |
| 3,071,827 | A | 1/1963 | Van Buran, Jr. | 411/458 |
| 3,112,488 | A | 12/1963 | Dettlott et al. | 227/147 |
| 3,331,180 | A | 7/1967 | Vissing et al. | 411/457 |
| 3,373,646 | A | 3/1968 | Ehlert | 411/473 |
| 3,542,273 | A | 11/1970 | Hedrick | |
| 3,670,941 | A | 6/1972 | Grinnell et al. | 227/139 |
| 3,693,863 | A | 9/1972 | Black | 227/148 |
| 3,711,008 | A | 1/1973 | Clifford et al. | 227/147 |
| 3,741,068 | A | 6/1973 | Andemskiewicz | 52/712 |
| 3,813,985 | A | 6/1974 | Perkins | |
| 3,821,919 | A | 7/1974 | Knohl | |
| 3,875,648 | A | 4/1975 | Bone | 29/417 |
| 3,885,491 | A | 5/1975 | Curtis | |
| 3,945,293 | A | 3/1976 | Krol | 85/49 |
| 3,969,975 | A | 7/1976 | Krol | |
| 4,126,258 | A | 11/1978 | Martin et al. | 227/148 |
| 4,126,259 | A * | 11/1978 | Galer et al. | 227/148 |
| 4,131,975 | A | 1/1979 | Niedecker | 24/30.5 |
| 4,907,730 | A | 3/1990 | Dion | |
| 4,923,350 | A | 5/1990 | Hinksman et al. | 411/452 |
| 4,925,141 | A | 5/1990 | Classen | 248/217.2 |
| 4,949,929 | A | 8/1990 | Kesselman et al. | 240/300 |
| 5,027,573 | A | 7/1991 | Commins et al. | 52/489 |
| 5,054,678 | A | 10/1991 | Nasiatka | 227/148 |
| 5,222,975 | A | 6/1993 | Crainich | 52/489 |
| 5,333,979 | A | 8/1994 | Raffoni | 411/477 |
| 5,738,473 | A | 4/1998 | Tebo | 411/460 |
| 6,071,054 | A | 6/2000 | Tebo | 411/459 |
| 6,098,865 | A * | 8/2000 | Tebo | 227/147 |
| 6,155,472 | A * | 12/2000 | Deziel | 227/147 |
| 6,318,620 | B1 * | 11/2001 | Anstett et al. | 227/148 |

FOREIGN PATENT DOCUMENTS

| | | | |
|---|---|---|---|
| GB | 776390 | 6/1957 | 411/458 |
| IT | 443789 | 1/1949 | |

* cited by examiner

*Primary Examiner*—Scott A. Smith
(74) *Attorney, Agent, or Firm*—Fish & Richardson P.C.

(57) ABSTRACT

A device and method for driving a first prong of a multi-pronged fastener into a first board and bending a second prong angularly to give it a desired orientation with respect to the first prong. The invention involves an alignment structure, a first driver for driving the fastener into the first board, and a second driver for impacting and bending the second prong angularly with respect to the first prong.

26 Claims, 15 Drawing Sheets

FASTENER DRIVING DEVICE

TECHNICAL FIELD

This invention relates to carpentry, building, and construction, and more particularly to an apparatus and method for driving multi-pronged fasteners into two or more boards.

BACKGROUND

My U.S. Pat. Nos. 5,684,324 and 5,927,923 describe two-and three-pronged fasteners that can be used to join adjacent deck boards to each other and/or to a joist below them while not being visible from the surface. My U.S. patent application Ser. No. 09/271,962, filed Mar. 18, 1999, now U.S. Pat. No. 6,071,054 describes a three-prong fastener that is particularly useful in securing two deck boards to each other and to an underlying joist when the deck boards are oriented diagonally relative to the joists. This fastener is shown in FIG. 1 hereto, and is shown securing adjacent deck boards to each other in FIGS. 2 and 3.

FIG. 1 shows three-pronged fastener 500 with forward-facing prongs 514 and 516 and rearward-facing prong 515. FIG. 2 shows several such fasteners joining deck boards 508, 510 to each other and to joists 509, 511, 513, where deck boards 510 are oriented diagonally to joists 509, 511, 513. As shown in FIG. 3, forward facing prongs 514, 516 are first driven into deck board 508 and joist 513, respectively, and deck board 510 is then hammered against rearward-facing prong 515 to drive the latter into deck board 510.

Staple driving devices are used in carpentry, as well as building and construction work. In such uses, both points of a staple are typically driven into the same board or boards. My U.S. patent application Ser. No. 09/137,012, filed Aug. 20, 1998, now U.S. Pat. No. 6,098,865 describes a staple driving device that can be used to quickly, easily, and securely drive a two-pointed staple fastener into a deck board and a joist below it, such that the staple is not visible from above the deck. This device is shown in FIGS. 4–6 hereto. The staple driving device has alignment structure 10, driver 12, staples 14, magazine 16, alignment plate 18, handle 20, and hammer 22.

Alignment structure 10 has first board abutment surface 24 and second board abutment surface 26 which abut respectively first board surface 28 of first board 30 and second board surface 32 of second board 34. First board 30 is above second board 34. First board 30 and second board 34 are oriented to each other so as to form included angle 36, at junction 38 (indicated in FIG. 4) of less than 180°, e.g., approximately 90°, in FIGS. 4–6. Alignment structure 10 defines staple delivery channel 44. When abutment surfaces 24, 26 abut board surfaces 28, 32, staple delivery channel 44 is near junction 38. As seen in FIG. 5, the device is positioned to drive first point 40 of staple 14 into first board surface 28 and second point 42 of staple 14 into second board surface 32. Magazine 16 is fitted partially within alignment structure 10. Magazine 16 defines staple supply channel 48 which joins staple delivery channel 44, so that staples 14 which are retained within staple supply channel 48 may pass into staple delivery channel 44. Driver 12 has striking portion 50 with broadened striking head 52, stock 54, and driving portion 56. Driver 12 is slidably fitted within alignment structure 10. Driving portion 56 is sized to be capable of sliding within staple delivery channel 44. Alignment plate 18 is fastened to alignment structure 10 so that it can abut third board surface 64 of first board 30. The device has handle 20, having grips 66 fastened to alignment structure 10. As shown in FIG. 6, the device has two internal springs 68 disposed within driving channel 62 so that, when driver 12 is driven forward, by a hammer blow delivered to striking head 52, for example, internal springs 68 are compressed between stock 54 of driver 12 and compression surface 70 that bounds driving channel 62 within alignment structure 10.

SUMMARY

The invention, in general, features a device for driving a first prong of a multi-pronged fastener into an adjacent board and bending a second fastener prong, so that it has a desired orientation with respect to the board. The device includes an alignment structure, a first driver, and a second driver. The alignment structure has a first abutment surface for abutting one of the boards. The alignment structure defines a fastener delivery channel that ends near the junction of the boards. The first and second drivers are movably connected to the alignment structure. The first driver is positioned so as to be able to contact the fastener and to drive the first prong into one of the boards. The second driver is positioned so as to be able to contact the second prong and bend it angularly with respect to the first prong.

In operation, the abutment surface of the alignment structure is brought into contact with one of the boards. The first driver is activated, so that it impacts a fastener situated in the fastener delivery channel and drives the first prong into one of the boards. The second driver is also activated so that it impacts the second prong and bends it angularly with respect to the first prong.

Preferred embodiments are adapted to drive a three-pronged fastener, so as to join a first deck board to a joist beneath it, where the first deck board and joist are oriented at right angles to each other, and to bend a rearward-facing prong, so that it projects from the first deck board at approximately a 90° angle, so that the rearward-facing prong is positioned to be driven into a second deck board. Alternately, the device may be adapted to drive fasteners and bend prongs at any desired angle.

Preferred embodiments include a third driver for bending the third prong, which extends from the board, in an alternate direction. Embodiments with a third driver may include a mechanism for detecting the orientation of the upper board and selectively engaging either the second or third driver for bending the third prong in either of two directions. Mechanical catches, levers, linkages, wedges, rollers, springs, pivots, as well as electrical, electromagnetic, magnetic, hydraulic, or pneumatic devices may be used to selectively engage either the second or third driver. The second and third drivers may be activated, so as to impact and bend the third prong, by the motion of elements connected to the first driver. In other embodiments, the second or third driver may be connected to the first driver, so that all drivers are activated simultaneously.

Preferred embodiments further include an alignment plate, attached to the alignment structure. The alignment plate may be spaced relative to the fasteners to align the prongs for driving them into boards, when the alignment plate abuts one of the boards. Preferred embodiments further also include a magazine containing a plurality of multi-pronged fasteners to be driven successively into boards, a handle for grasping the device, or springs to return the drivers and other components to their initial positions after the fasteners are driven and/or bent.

The force required to activate the drivers may be supplied manually, or by a pneumatic, hydraulic, elastic, electrical, electromagnetic, electrostatic, magnetic, combustion, or explosive device. For example, the force may be provided by a hammer blow, gunpowder, a spring, an electric motor, an internal combustion engine, or a compressed air device. The force required to activate the drivers may be supplied from an offset orientation, for example, with cams, rollers, or linkages.

Embodiments of the invention may include one or more of the following advantages. The device may be used to drive different points of a multi-pronged fastener into one or more boards and to bend another prong in a desired direction. The device may facilitate connecting boards in a way that conceals the fasteners. The device may reduce workers' time in building, construction, or carpentry work. The device may be adapted to hold a plurality of fasteners. Fasteners may be driven and bent in one continuous operation. One source may provide the energy required to drive and bend respective prongs of the fasteners. The device may be used with fasteners that have any cross-sectional profile, for example, round, circular, square, or rectangular. The fasteners may be made of a metal, such as steel, copper, aluminum, a metal alloy, or any suitable material. The device can be used with boards of wood, foam, plastic, fiberglass, or any suitable material.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 7:
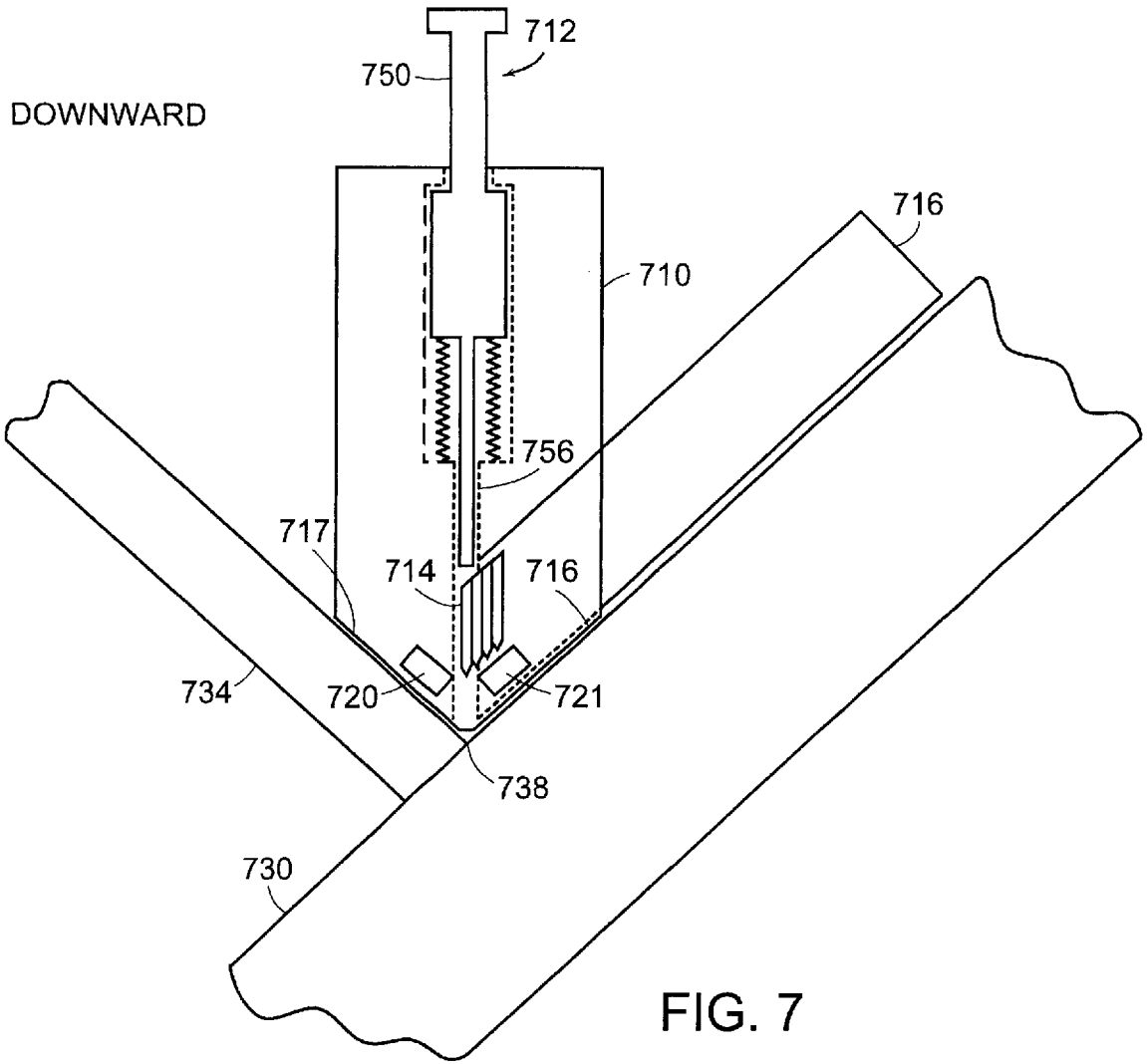
FIG. 7 is a top horizontal sectional view of a fastener driving device.
Figure 8:
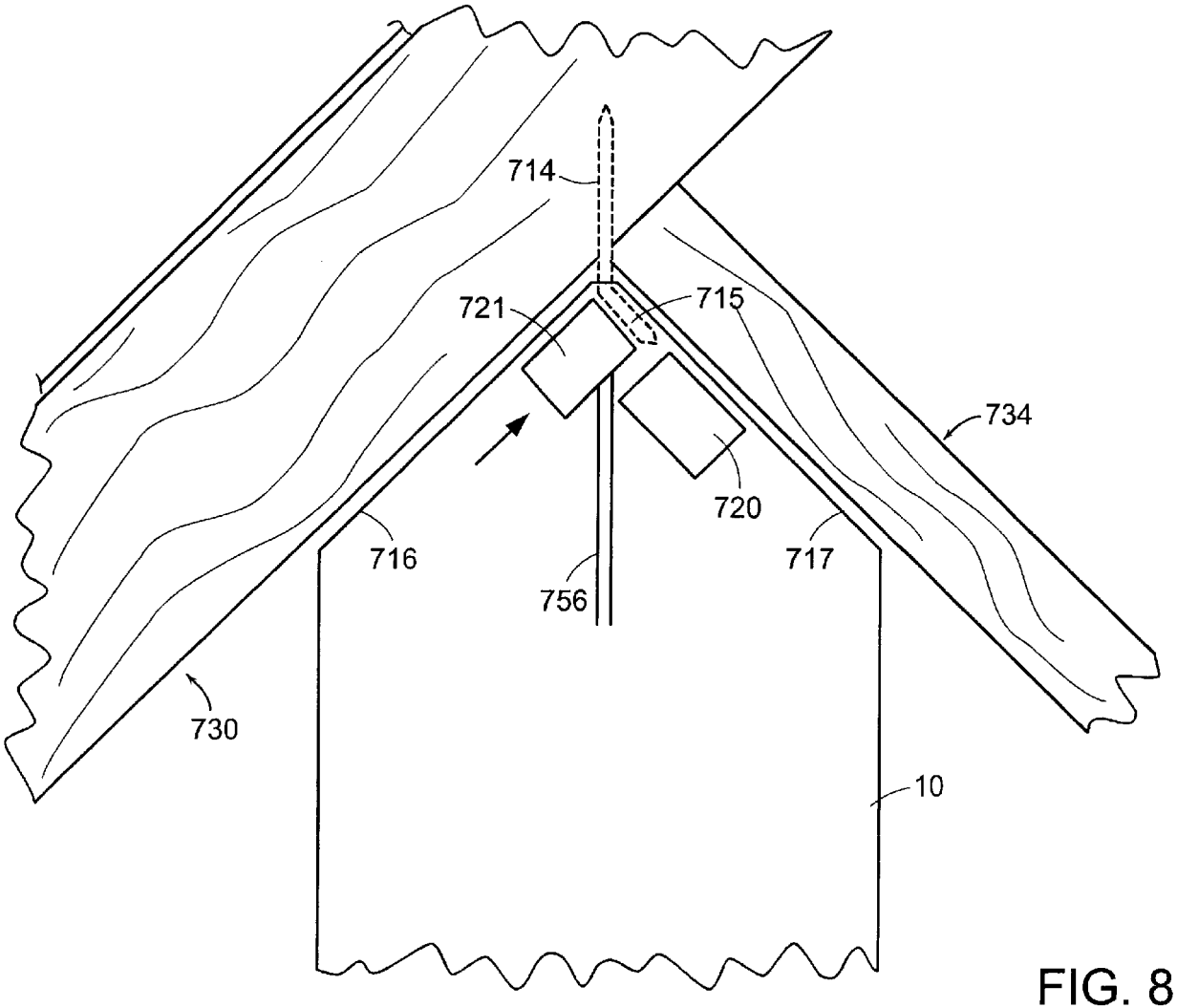
FIG. 8 is a top horizontal sectional view of the fastener driving device of FIG. 7 with a bent prong.
Figure 9:
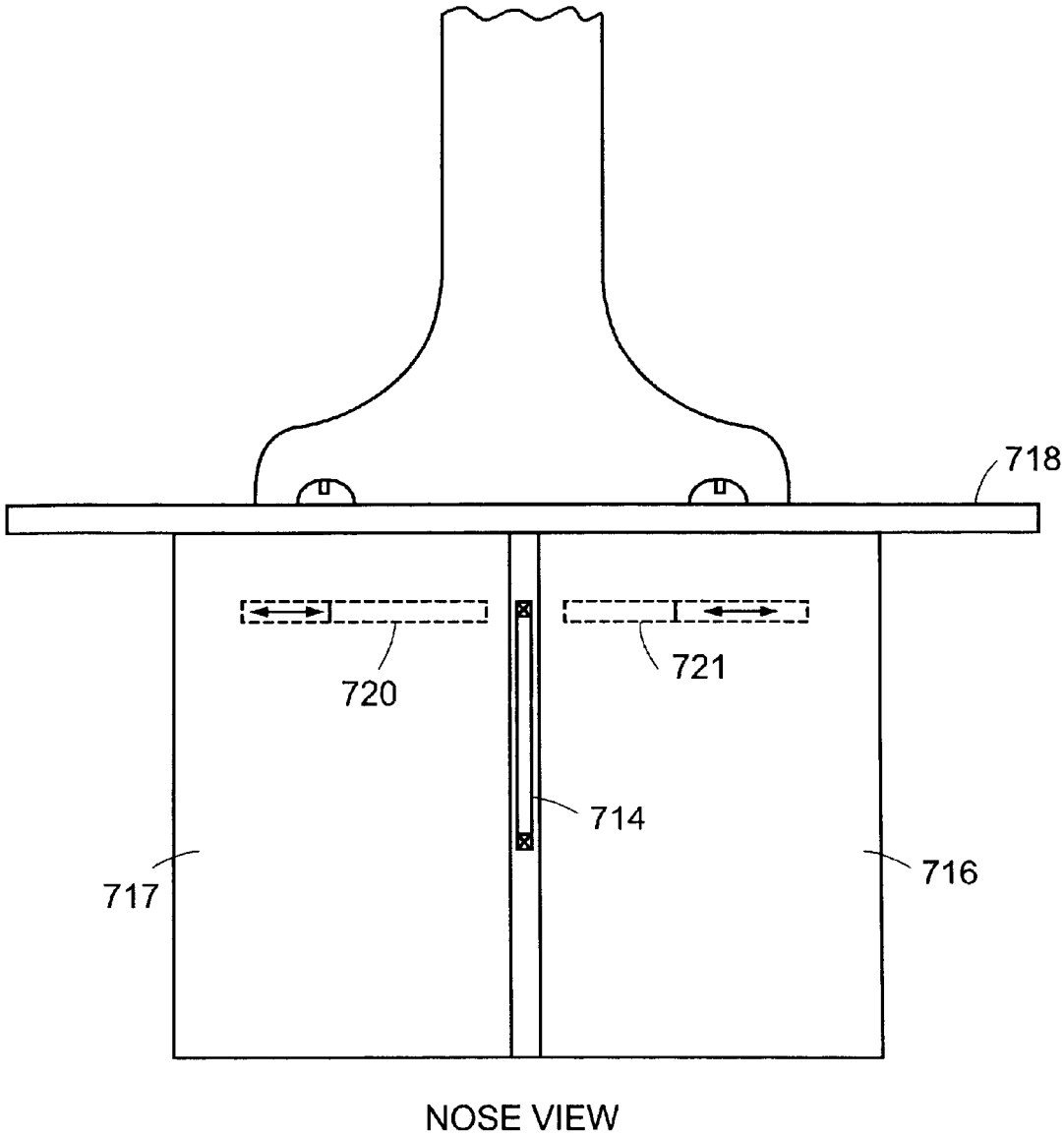
FIG. 9 is a front view of the fastener driving device of FIG. 7.

Referring to FIGS. 7–9, there is shown a fastener driving device employing alignment structure 710, first driver 712, fasteners 714, magazine 716, second driver 720, and third driver 721.

Alignment structure 710 has first abutment surface 716 and second abutment surface 717. Abutment surfaces 716, 717 are flat surfaces oriented at an angle to each other that give alignment structure 710 a wedge shape. As seen in FIGS. 7–9, alignment structure 710 is positioned at junction 738 of first board 730 and second board 734, so that first abutment surface 716 rests against first board 730 and second abutment surface 717 rests against second board 734. Board 730 is a deck board, and board 734 is a supporting joist thereunder.

The structure and operation of alignment structure 710, first driver 712, and alignment plate 718 are similar to the corresponding elements of the staple driving device described in my U.S. patent application Ser. No. 09/137,012, filed Aug. 20, 1998, which is incorporated herein by reference.

Driver 712 is slidably connected to alignment structure 710 and is capable of moving in fastener delivery channel 756 toward junction 738 so as to contact fastener 714 and drive its two parallel, forward-facing prongs into boards 730, 734. Second and third drivers 720, 721 (shown diagrammatically in FIG. 7) are also slidably connected to alignment structure 10. Second and third drivers 720, 721 are capable of moving toward junction 738. Second driver 720 moves substantially parallel to second abutment surface 717 and third driver 721 moves substantially parallel to first abutment surface 716.

Figure 2:
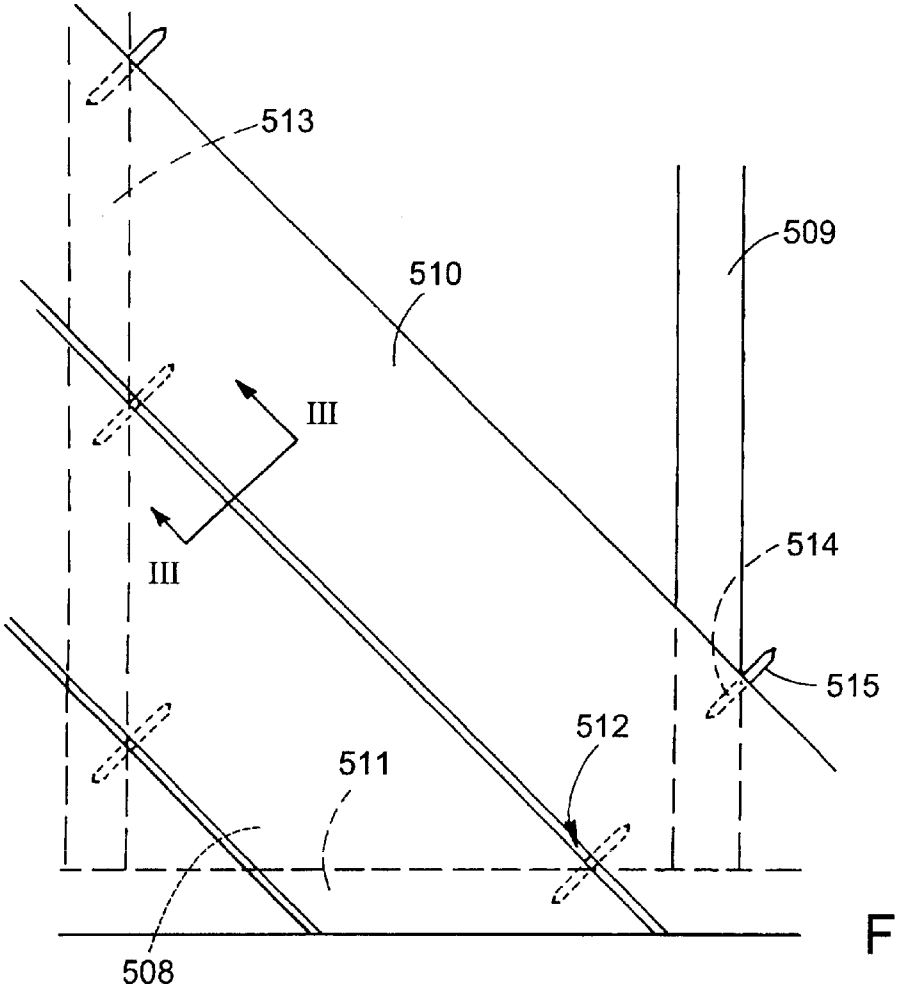
FIG. 2 shows a top view of FIG. 1 fasteners securing adjacent floorboards to ajoist.
Figure 1:
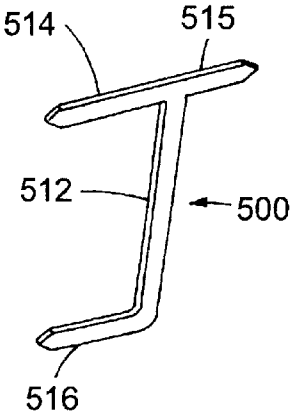
FIG. 1 shows a three-pointed fastener for securing boards to each other.
Figure 3:
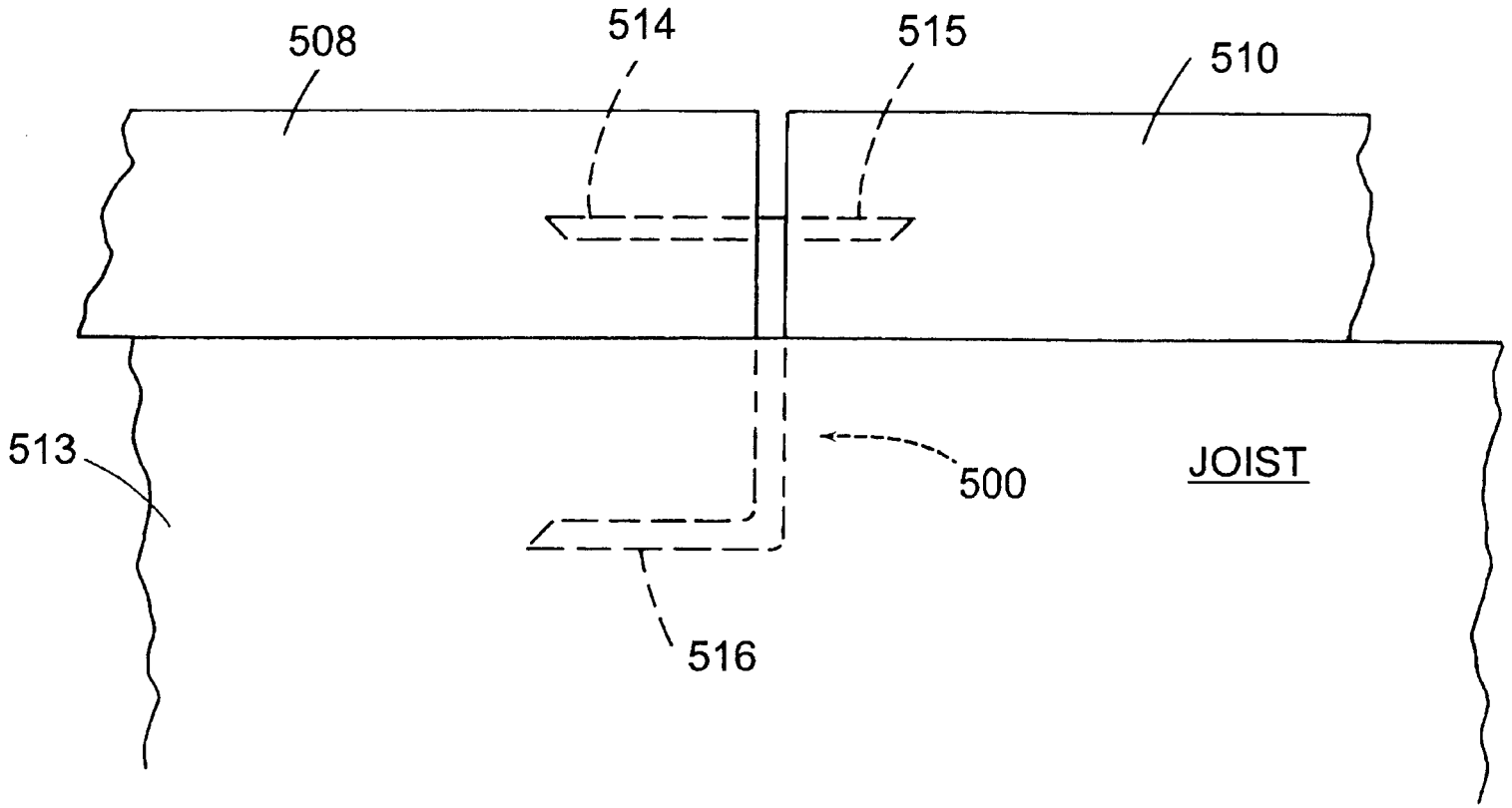
FIG. 3 is a partial sectional view, taken at III—III of FIG. 2, showing a fastener of FIG. 1 securing adjacent floorboards to ajoist.
Figure 4:
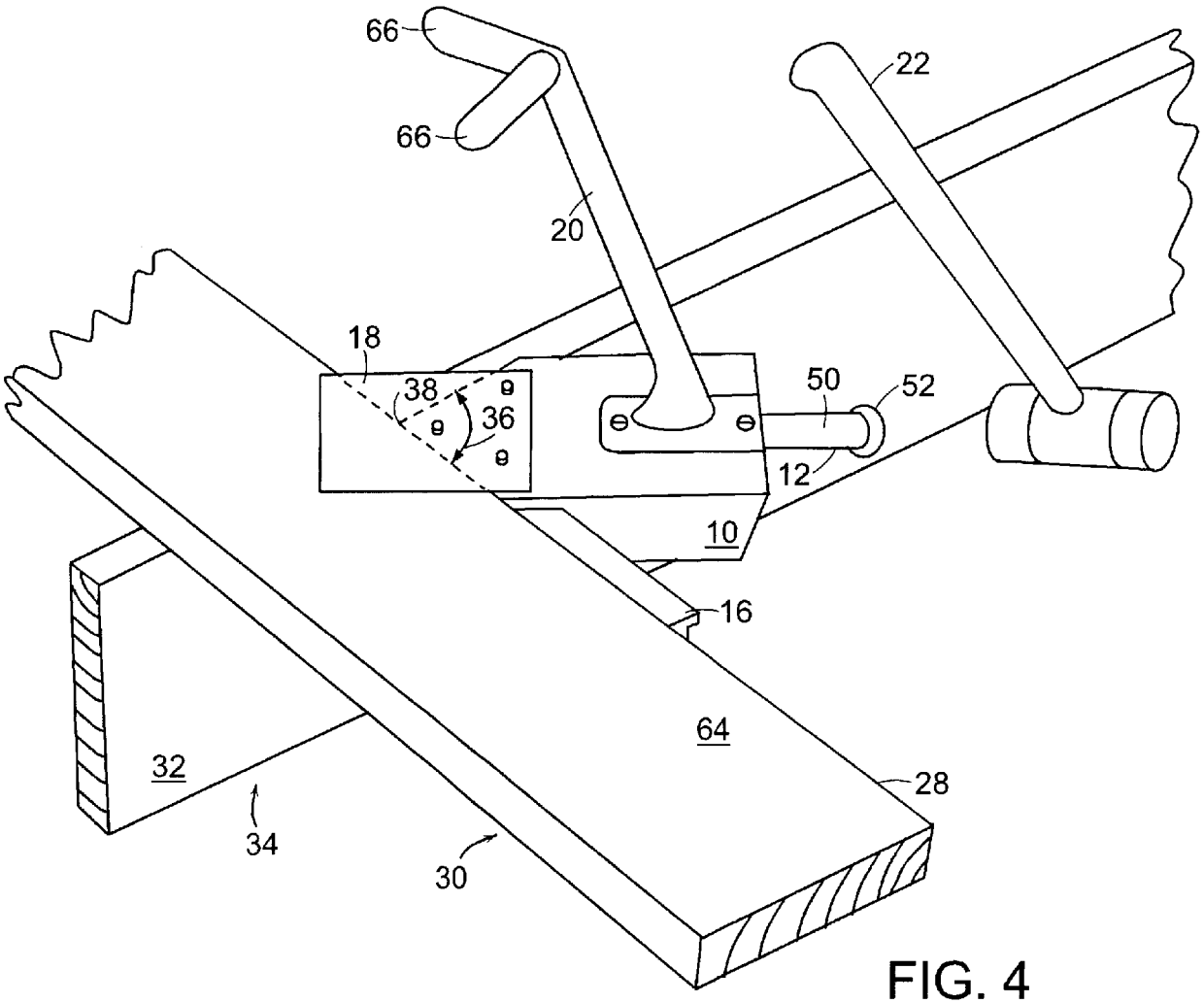
FIG. 4 is a perspective view of a two-pointed staple driving device.
Figure 5:
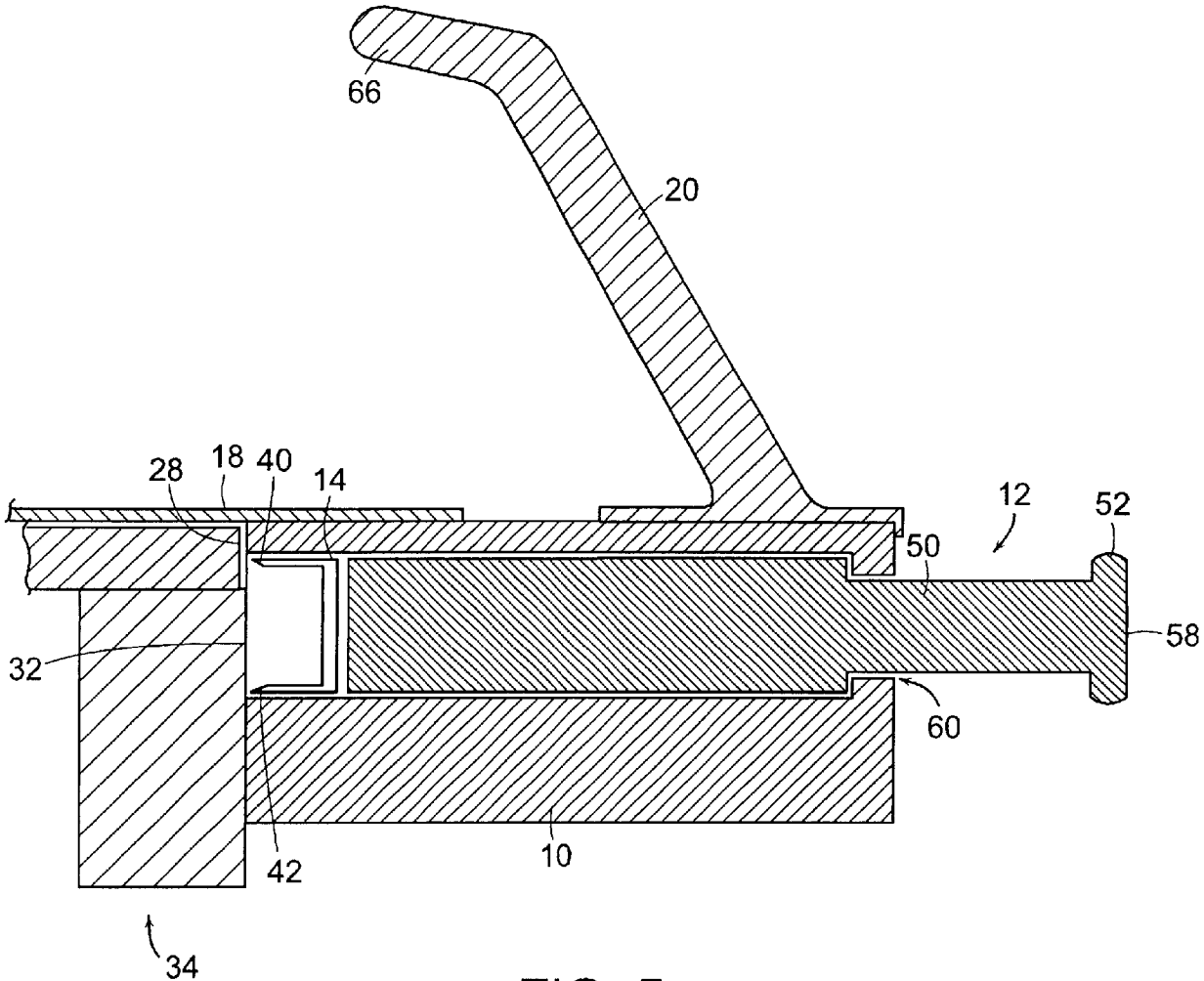
FIG. 5 is a side vertical sectional view of the staple driving device of FIG. 4.
Figure 6:
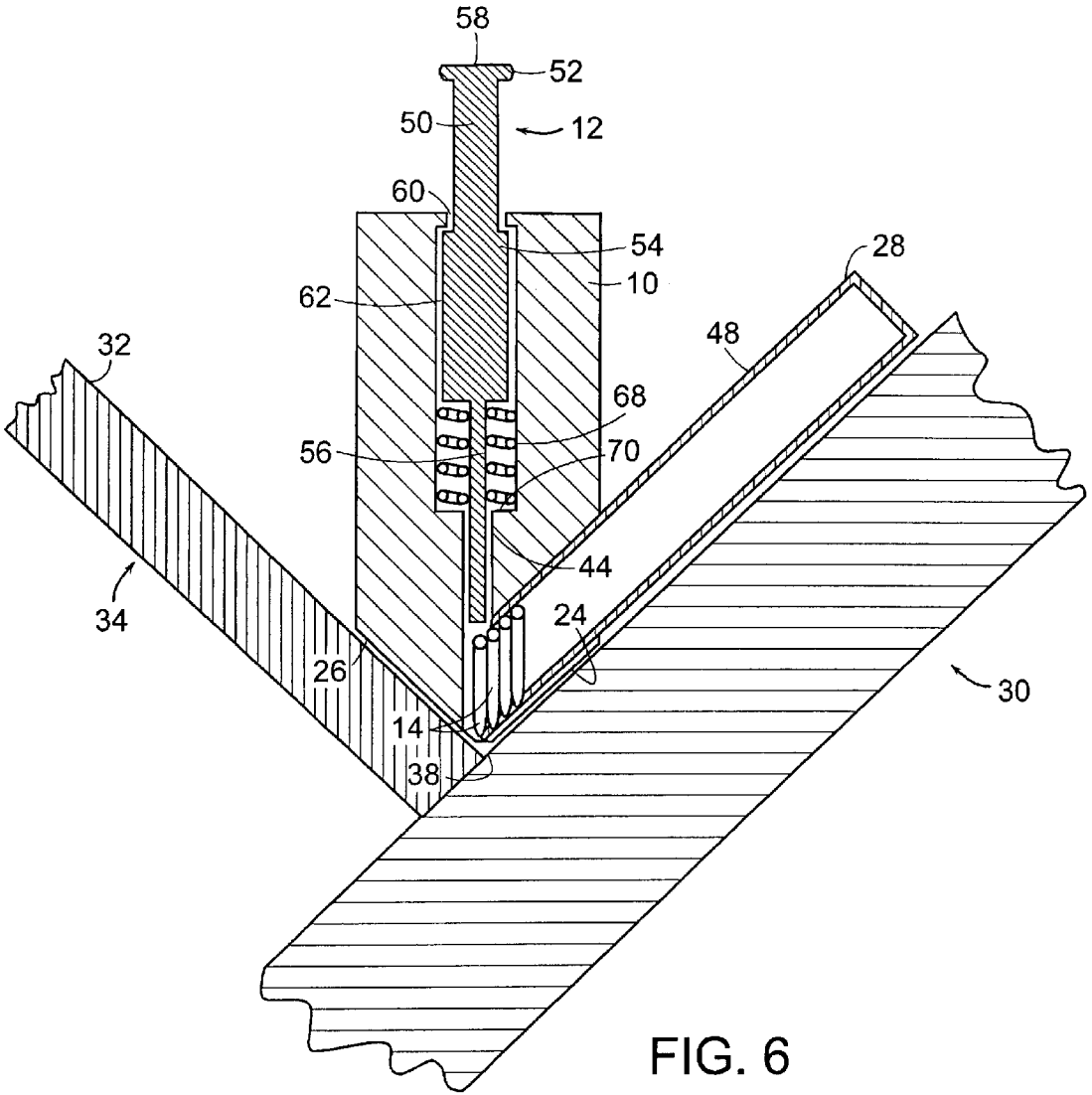
FIG. 6 is a top horizontal sectional view of the staple driving device of FIG. 4.

Each of fasteners 714 has rear prong 715, which is not driven into either of boards 730, 734 by first driver 12. (Fasteners 714 are similar in design to fastener 500 of FIG. 1.) Thus, when fastener 714 has been driven into boards 730, 734, rear prong 715 is in position to be contacted by second or third drivers 720, 721 and bent. FIG. 8 shows rear prong 715 bent by third driver 721, so that it is perpendicular to deck board 730 in position to be driven into the next deck board to be added. If the device were placed on the other side of joist 734, second driver 720 would be used instead. FIG. 9 is a front view of a fastener driving device showing alignment structure 710, alignment plate 718, fastener 714, and relative positions of second and third drivers 720, 721 (in phantom).

First driver 712 may be activated, so as to drive fastener 714 into boards 730 or 734, and second or third drivers 720, 721 may be activated, so as to move toward and bend rear prong 715, by any appropriate mechanism or technique. For example, drivers 712, 720, 721 may be activated manually, such as with a hammer strike, as well as by pneumatic, electromagnetic, magnetic, electrostatic, or explosive devices. The force required to activate drivers may be delivered directly to drivers or through any appropriate mechanism or technique, for example linkages, cams, cables, springs, pivots, or rollers. The forces required to activate either of second or third drivers 720, 721 may be provided by the motion of first driver 712 through an appropriate linkage.

First, second, and third drivers 712, 720, 721 are preferably slidingly connected to alignment structure 710. Each driver may reside in a channel, for example fastener delivery channel 756 (FIGS. 7 and 8), defined by alignment structure 710. Alternately, drivers may be connected to alignment structure 710 by grooves, levers, linkages, rollers, gears, or any other suitable connection.

Fastener driving devices according to the invention may be configured so that only one of the second and third drivers 720, 721 is engaged so as to move toward and bend rear prong 715, or so that neither of second and third drivers 720, 721 are so engaged. There are many mechanisms or techniques that may be employed for engaging or disengaging second and third drivers. For example, second and third drivers 720, 721 may be automatically engaged or disengaged by a trigger or button projecting from abutment surfaces 716, 717 that contacts one of boards 730 or 734, or by an external linkage or button.

Figure 10:
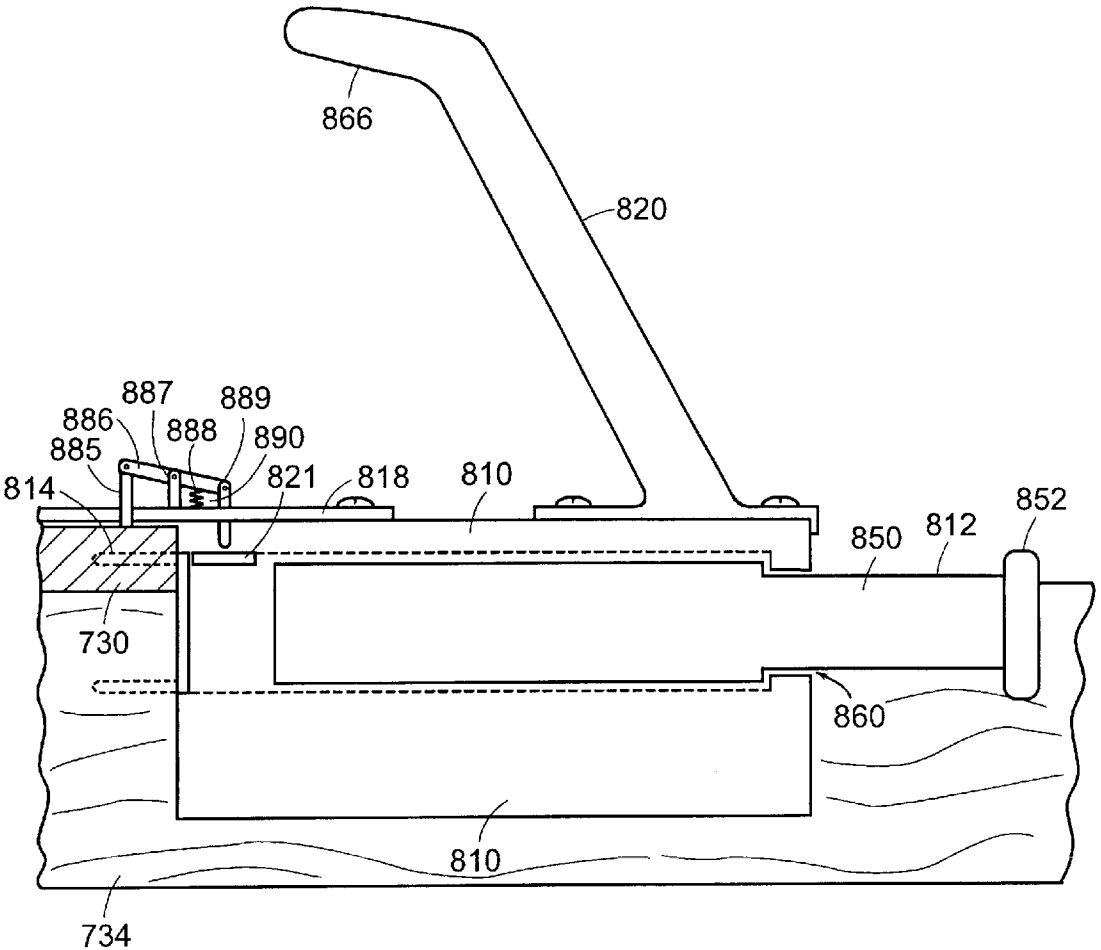
FIG. 10 is a side vertical sectional view of an alternate fastener driving device.

FIG. 10 shows one approach for selectively engaging only one of second and third drivers 720, 721. The alternate fastener driving device of FIG. 10 has button 885, which passes through alignment plate 818, which rests on top of deck board 730. Button 885 is pivotally connected to lever 886, post 887, and engagement rod 889. Engagement rod 889 passes through alignment plate 818 and alignment structure 810, and contacts third driver 821. Bias spring 890 is between lever 886 and alignment plate 818. Placing alignment plate against first board 830 raises button 885 and causes lever 886 to compress bias spring 890. The movement of lever 886 also presses engagement rod 889 downward, so that engagement rod 889 pushes third driver 821 into position for engagement. A similar arrangement of a button, lever, and rod is also used to engage driver 820.

Figure 11:
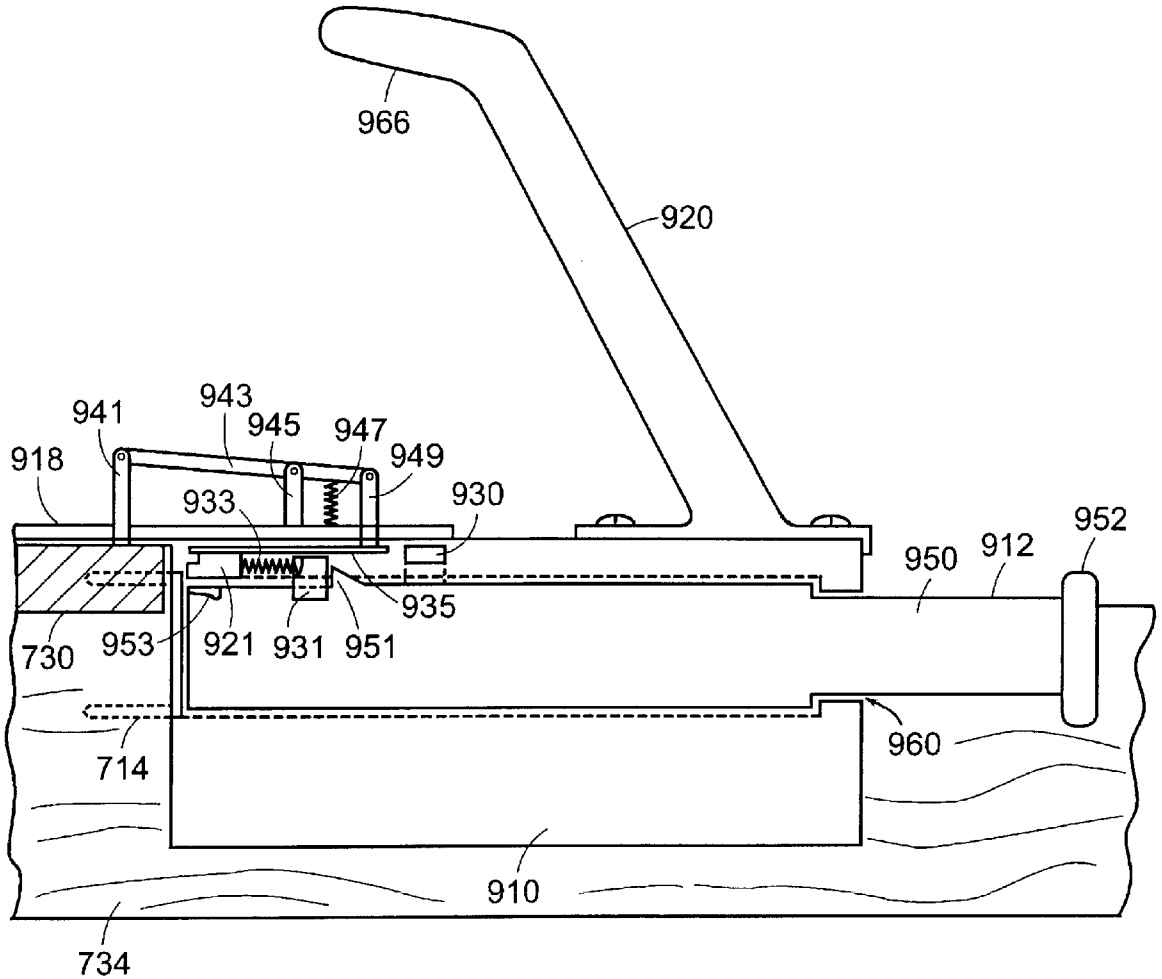
FIG. 11 is a side vertical sectional view of another alternate fastener driving device.
Figure 12:
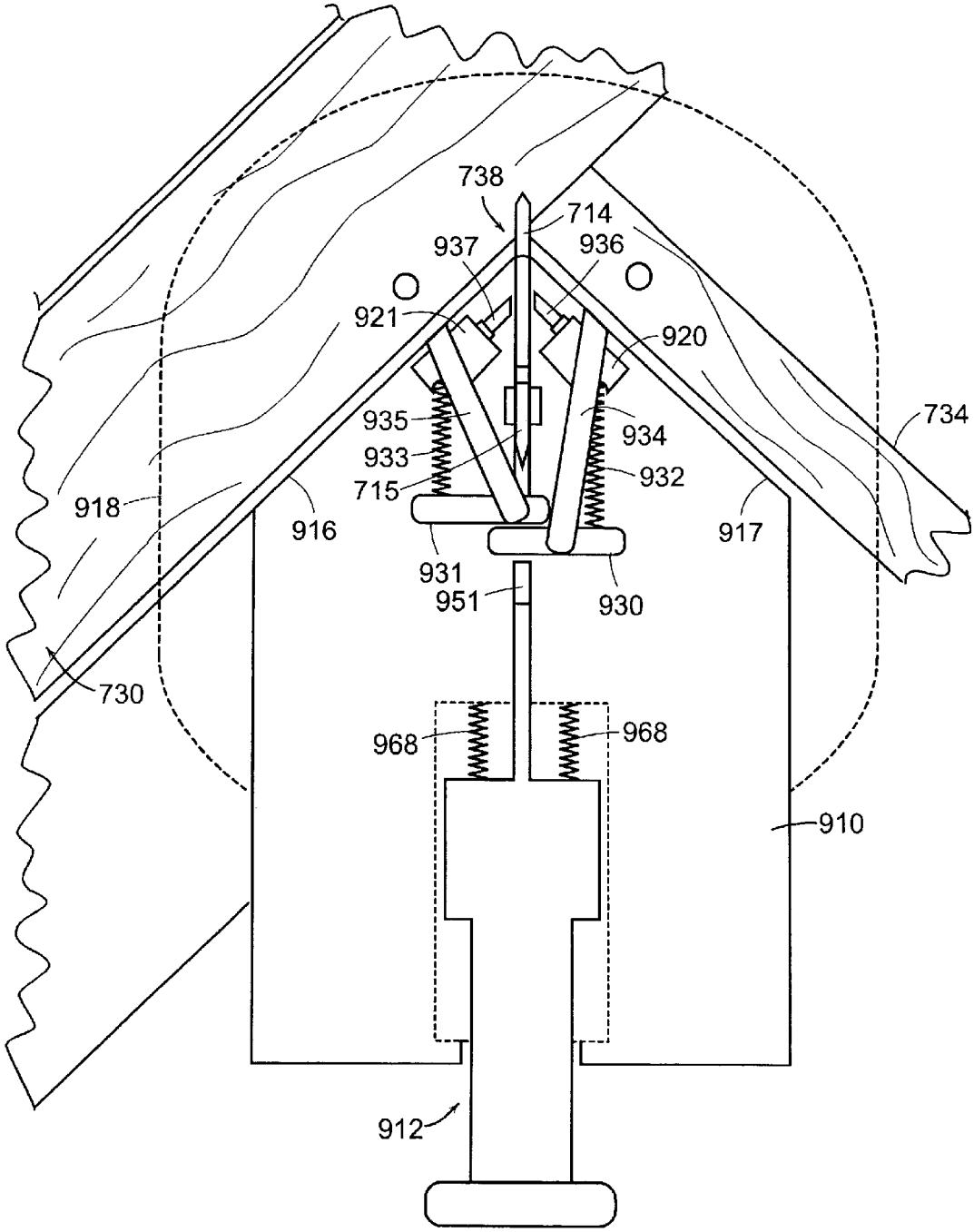
FIG. 12 is a top horizontal sectional view of the fastener driving device of FIG. 11.
Figure 13:
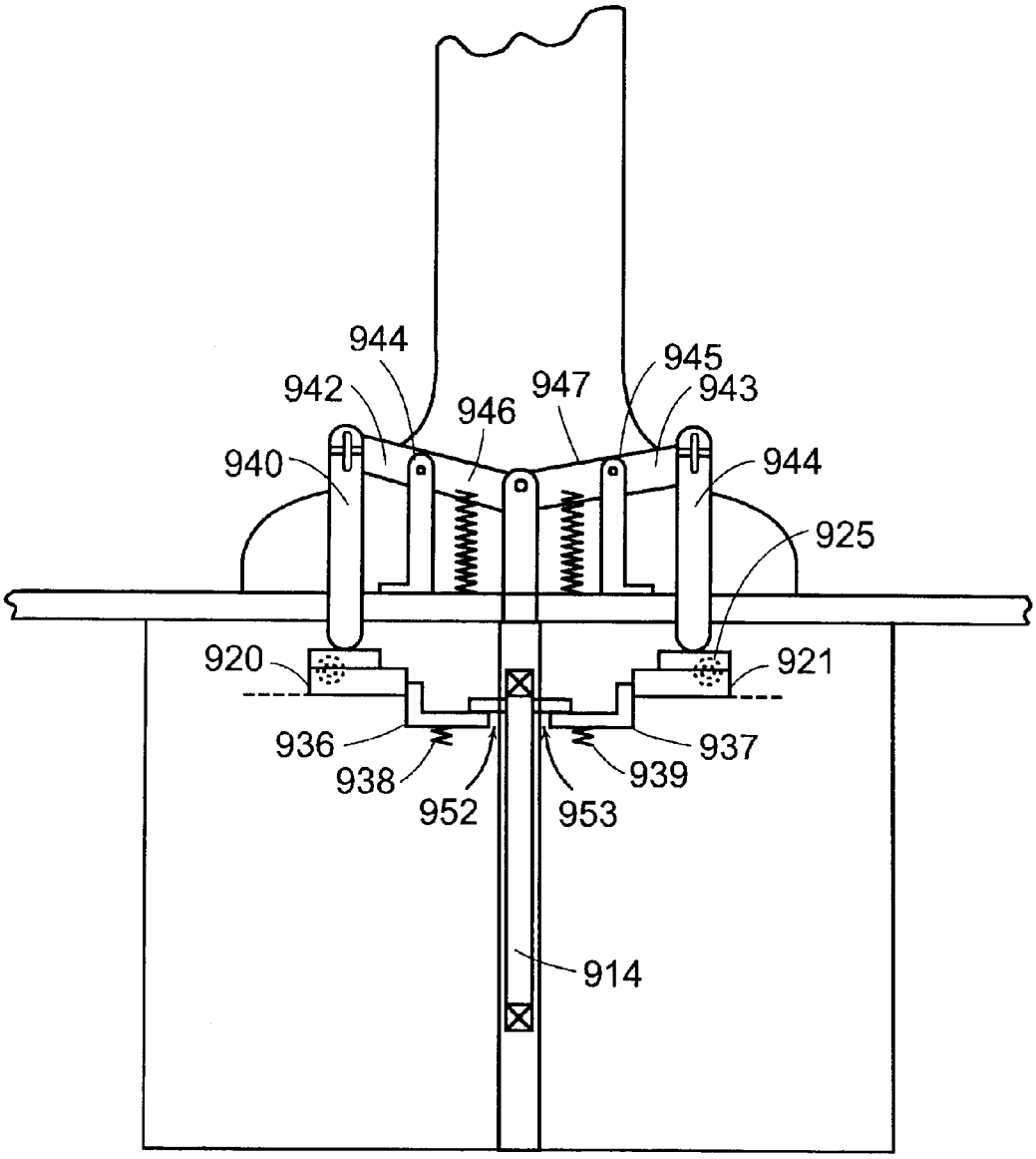
FIG. 13 is a front vertical sectional view of the fastener driving device of FIG. 11.

FIGS. 11–13 show another alternate fastener driving device in which force delivered to alternate first driver 912 compresses first or second drive springs 932, 933. Energy stored in compressed first or second drive springs 932, 933 is used to activate respective second or third drivers 920, 921 in order to contact and bend rear prong 715 of fastener 714.

The embodiment of FIGS. 11–13 employs alignment structure 910 that defines first and second abutment surfaces 916, 917, alignment plate 918, fastener 714 with rear prong 715, alternate first driver 912, compression springs 968, second driver 920, third driver 921, first slide member 930, second slide member 931, first drive spring 932, second drive spring 933, first guide plate 934, second guide plate 935, first drive catch 936, second drive catch 937, first catch bias spring 938, second catch bias spring 939, first engagement button 940, second engagement button 941, first lever 942, second lever 943, first post 944, second post 945, first engagement bias spring 946, second engagement bias spring 947, first engagement rod (not shown, as it is obscured by other elements) and second engagement rod 949.

Alternate first driver 912 has spring compression member 951, which projects upwardly and first and second spring release wedges 952, 953, which project laterally.

In the use of the embodiment of FIGS. 11–13 shown, alignment structure 910 is situated at the junction of boards 730, 734, so that alignment plate 918 rests against first board 730. As shown in FIG. 11, the presence of first board 730 elevates second engagement button 941 so that it slides upward relative to alignment plate 918. The motion of second engagement button 941 is translated through the pivotal movements of second lever 943 about second post 945 to compress second engagement bias spring 947 and to lower second engagement rod 949, which is slidably connected to alignment plate 918 and alignment structure 910. The lowering of second engagement rod 949 causes it to press against second guide plate 935, which, in turn, lowers second slide member 931. Second drive spring 933 is disposed between second slide member 931 and third driver 921. Thus, the elements connected to second engagement button 941 engage third driver 921 for contacting and bending rear prong 715 of fastener 714. Similar elements, which connect first engagement button 940 to second driver 920, engage second driver 920 for contacting and bending rear prong 715 when first engagement button 940, rather than second engagement button 941, is elevated.

With the alignment structure 910 situated at junction 738 between boards 730, 734, the embodiment of FIGS. 11–13 is positioned to drive fastener 714 into boards 730, 734 and bend rear prong 715. Alternate first driver 912 is activated—by a hammer blow, for example, or by any other suitable technique—so that alternate first driver 912 is propelled toward junction 738, and compression springs 968 are compressed. During its motion toward junction 738, alternate first driver 912 contacts fastener 714—thereby driving fastener 714 into boards 730, 734—and spring compression member 951 contacts second slide member 931—thereby pushing second slide member 931 in the direction of junction 738 and compressing second drive spring 933 between second slide member 931 and third driver 921. Third driver 921 is slidably connected to alignment structure 910; however, third driver 921 is held in place, relative to alignment structure 910, by second drive catch 937. Second drive catch 937 is slidably connected to alignment structure 910. Second catch bias spring 939, which is compressed between alignment structure 910 and second drive catch 937, detains second drive catch 937 in an upward position where it blocks the motion of third driver 921. As alternate first driver 912 approaches junction 738, however, second spring release wedge 953 comes in camming contact with second drive catch 937, thus pushing second drive catch 937 downward and further compressing second catch bias spring 939. At approximately this point, alternate first driver 912 has driven fastener 714 into boards 730, 734 but rear prong 715 protrudes at a 40° angle to the vertical board surface. When second spring release wedge 953 has lowered second drive catch 937 sufficiently, so that it no longer impedes the movement of third driver 921, the energy stored in compressed second drive spring 933 is released, forcing second driver 921 toward the opposing second abutment surface 917, so that second driver 921 contacts and bends rear prong 715 to form approximately a 90° angle with respect to first board 734.

Similar elements, which connect first slide member 930 to second driver 930 and which lower first drive catch 936, are involved in a similar process for bending rear prong 715 in the opposite angular direction, when activated by a respective button (not shown).

After fastener 714 has been driven into boards 730, 734 and rear prong 715 has been bent, compressions springs 968 expand, thus propelling alternate first driver 912 away from junction 738. Likewise, second drive spring 933 expands, so that third driver 921 moves away from junction 738 and second slide member 931 moves away from third driver 921.

Figure 14:
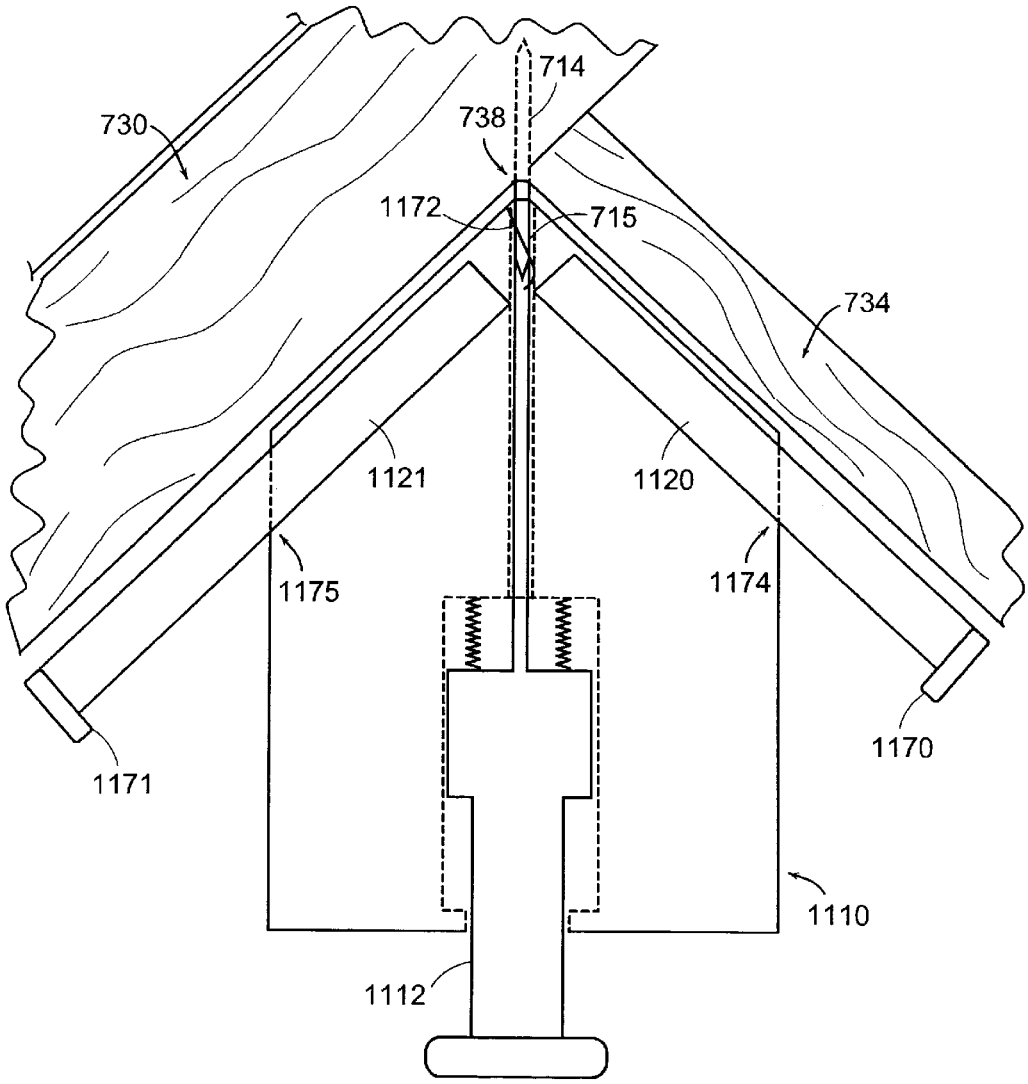
FIG. 14 is a top horizontal sectional view of a fastener driving device.

FIG. 14 shows a fastener driving device in which second driver 1120 and third driver 1121 project through respective first and second apertures 1174, 1175 in alignment structure 1110. In this embodiment, second and third drivers 1120, 1121 are activated by imparting force to second striking head 1170 or third striking head 1171, so that either second or third driver 1120, 1121 will impact and bend rear prong 715. After rear prong 715 has been bent, return spring 1172 pushes either second or third driver 1120, 1121 back to its respective initial position.

Figure 15:
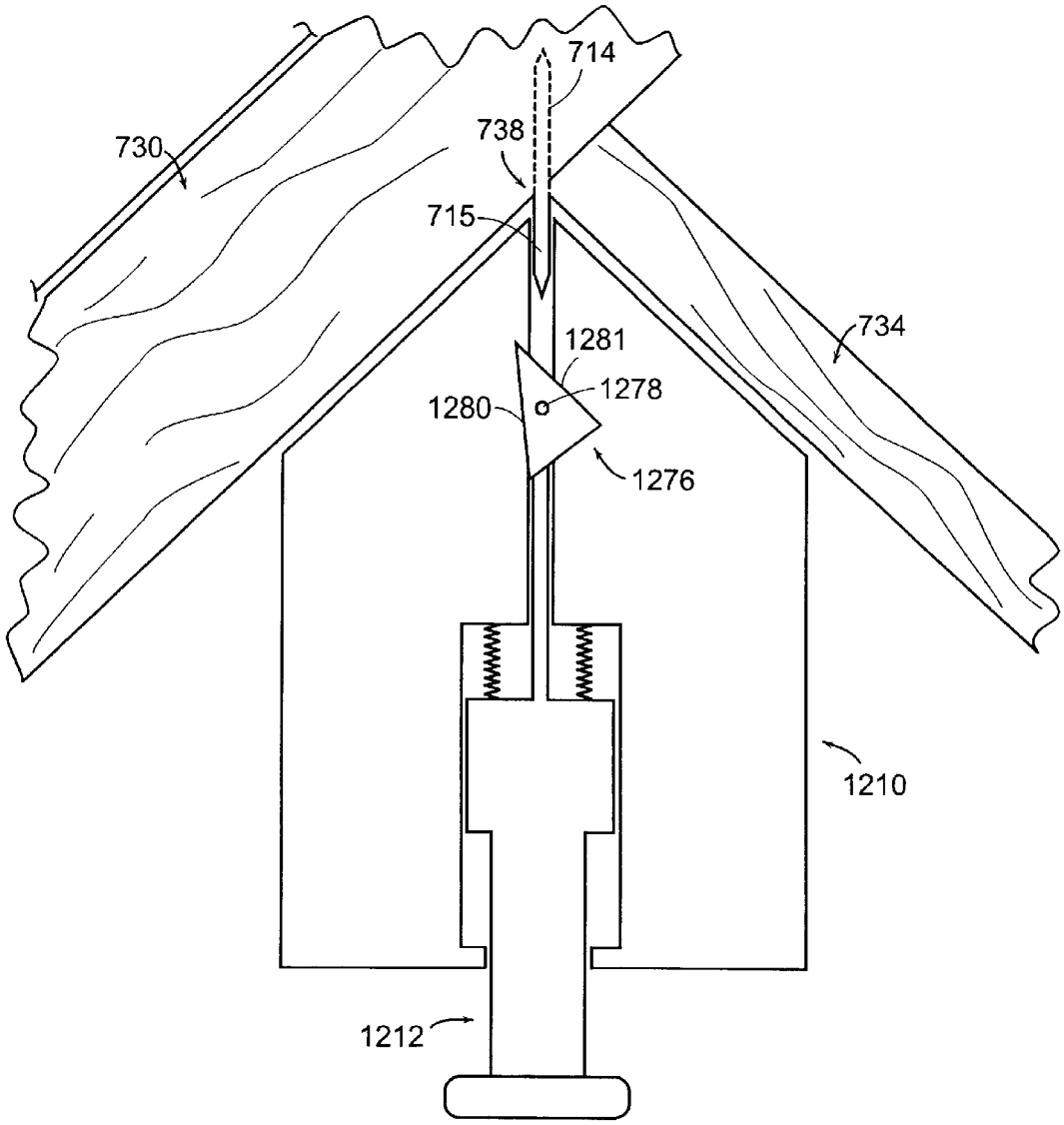
FIG. 15 is a top horizontal sectional view of a fastener driving device.
Figure 16:
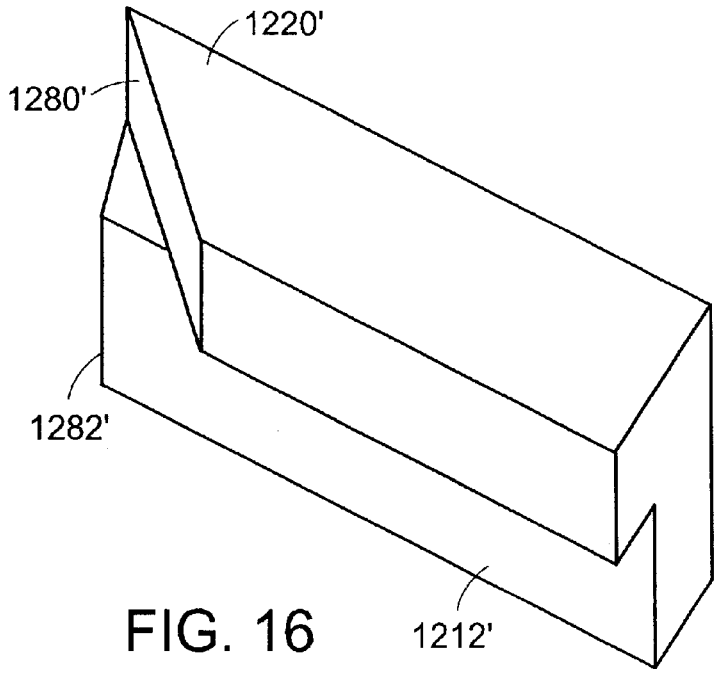
FIG. 16 is a perspective view of an alternate configuration for first and second drivers for a fastener driving device.
Figure 17:
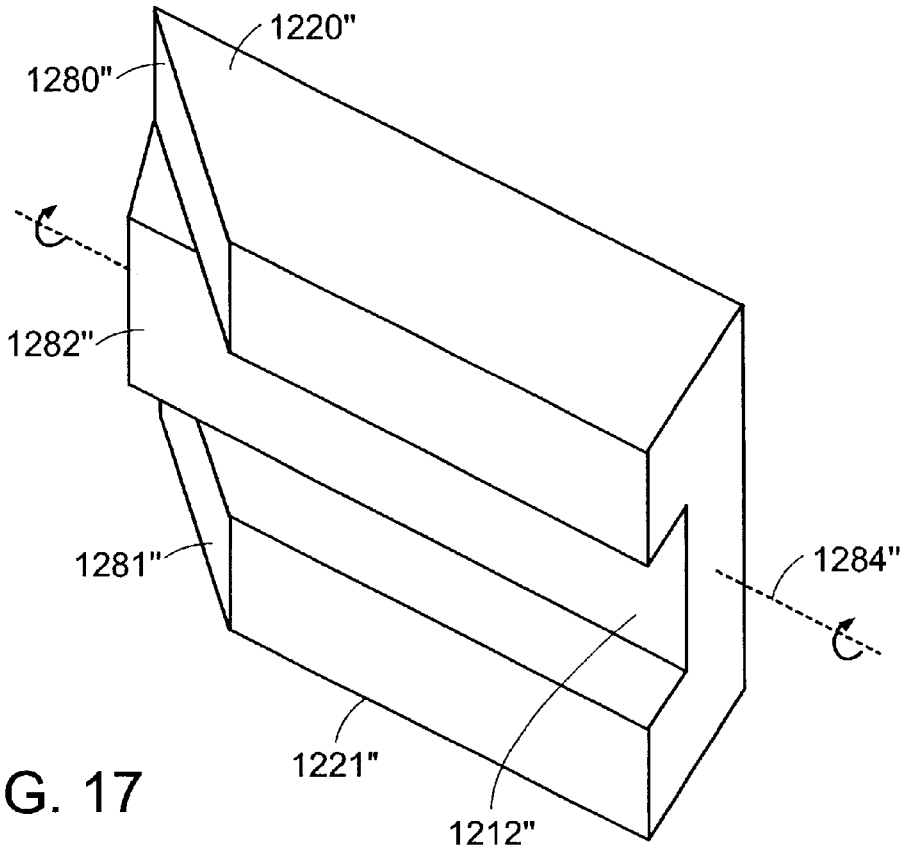
FIG. 17 is a perspective view of an alternate configuration for first, second, and third drivers for a fastener driving device.

FIGS. 15–17 relate to fastener driving devices in which the second or third drivers, which impact and bend rearward-facing prongs, are connected to the first driver. Referring to FIG. 15, there is shown a fastener driving device having triangular driving element 1276 connected on top of first driver 1212 by connection post 1278. In the position shown in FIG. 15, triangular driving element 1276 is positioned to impact and bend rear prong 715 away from first board 730, so that rear prong 715 will be oriented at approximately a 90° angle to first board 730. In this embodiment, triangular driving element 1276, rather than the alternate forms of second and third drivers described above, is used to bend rear prong 715. When driver 1212 is activated and advances toward junction 738, second camming surface 1281 comes in camming contact with and bends rear prong 715. While second driving surface is bending rearward facing prong 715, first driver 1212 contacts fastener 714 and drives its forward-facing prongs into boards 730, 734. Triangular driving element 1276 may be fixed, relative to first driver 1212. Alternately, triangular driving element may be pivotable about post 1278, so that first camming surface 1280 can be oriented so that it comes in camming contact with and bends rear prong 715, as first driver 1212 advances toward junction 738. Like the second and third drivers in the embodiments described above, first camming surface 1280 and second camming surface 1281 are used to bend rear prong 715 in opposing directions.

Referring to FIG. 16, there is shown an alternative driver assembly, in which second driver 1220' is integrally connected on top of first driver 1212'. In this configuration, driving surface 1282' of first driver 1212' drives forward-facing prongs of a fastener into boards. In the same movement of first driver 1212', first camming surface 1280' of second driver 1220' impacts and, through camming contact with a rear prong, bends the rear prong. Alternately, as seen in FIG. 17, third driver 1221" may be connected below first driver 1212". In this embodiment, third driver 1221", having second camming surface 1281", is engaged by rotating the driver assembly about axis 1284", so that third driver 1221" is above first driver 1212". It will be understood that fastener driving devices that employ driver assemblies like the ones in FIGS. 16–17 may be designed to have the engaged second or third driver below, instead of above, the first driver.

A number of embodiments of the invention have been described. Nevertheless, it will be understood that various modifications may be made without departing from the spirit and scope of the invention. For example, the device may be constructed so as to bend rear prong 715 to any desired angle. Further, in addition to the foregoing description, there are other techniques for activating second and third drivers 920, 921 by the movement of alternate first driver 912. For example, the movement of alternate first driver 912 may trigger a pneumatic device that activates second and third drivers 920, 921. Accordingly, other embodiments are within the scope of the following claims.

What is claimed is:

1. Driving system for driving a multi-pronged fastener into a board having a first board surface comprising:

alignment structure having a first abutment surface for aligning with the first board surface, a fastener delivery channel, a multi-pronged fastener in said delivery channel, said fastener having a first prong, an impact surface that is transverse to said first prong, and a second prong that makes an angle of greater than 90° with said first prong, said delivery channel being positioned with respect to said first abutment surface so that said fastener in said delivery channel has its first prong directed to be driven into the first board surface when said first abutment surface abuts said first board surface, a first driver for impacting said impact surface of said fastener and driving said first prong of said fastener into said first board surface, said first driver being slidably connected with respect to said alignment structure, and a second driver slidably connected with respect to said alignment structure, said second driver being positioned so as to travel toward and impact said second prong and to bend said second prong to change its orientation with respect to said first prong.

2. The driving system of claim 1 wherein said second driver is positioned within a second channel so as to travel generally parallel to said first abutment surface in order to bend said second prong to change its orientation with respect to said first prong.

3. The driving system of claim 1, further comprising a plurality of multi-pronged fasteners, each of said plurality of fasteners capable of being positioned sequentially in said fastener delivery channel.

4. The driving device system of claim 1, wherein said fastener further comprises a third prong, said third prong directed to be driven into a second board surface when said first abutment surface abuts said first board surface.

5. The driving system of claim 1, further comprising a third driver, said third driver being slidably connected with respect to said alignment structure and said third driver being positioned so as to travel toward and impact said second prong and to bend said second prong to change its orientation with respect to said first prong.

6. The driving system of claim 5 wherein said third driver is positioned at an angle with respect to each of said first driver and said second driver.

7. The driving system of claim 5 wherein said first and second drivers are connected to and moveable with said first driver and said first driver defines a longitudinal axis.

8. The driving system of claim 7 wherein said second and third drivers are integral with said first driver.

9. The driving system of claim 7 wherein said second and third drivers are engaged or disengaged by rotating said first driver about said longitudinal axis.

10. The driving system of claim 1, further comprising a spring for delivering force to said second driver.

11. The driving system of claim 1, further comprising a compressed fluid device for delivering force to said second driver.

12. The driving system of claim 1, further comprising an explosive device for delivering force to said second driver.

13. The driving system of claim 1, further comprising an activation button for activating said second driver.

14. The driving system of claim 13, further comprising an activation element connected to said first driver, said first driver being moveable from a first position where said activation element is not in contact with said activation button to a second position where said activation element is in contact with said activation button, so that the movement of said first driver from said first position to said second position and said contact between said activation element and said activation button activates said second driver.

15. The driving system of claim 13 wherein said activation button is located remotely from said alignment structure.

16. The driving system of claim 15, further comprising a handle.

17. The driving system of claim 16 wherein said activation button is located on said handle.

18. The driving system of claim 1 wherein said driver is positioned at an angle with respect to said first driver.

19. The driving system of claim 1 wherein said second driver is connected to and is moveable with said first driver.

20. The driving system of claim 19 wherein said second driver is integral with said first driver.

21. Driving system for driving a triple-pronged fastener having first and second parallel sharp, pointed prongs joined together by a connecting portion into a first board surface of a first board and a second board surface of a second board, respectively, at a junction of said first and second boards, one said board overlying the other said board, the first and second surfaces making a first included angle of less than 180° between them, said fastener having a third sharp, pointed prong extending from said connecting portion in a different direction, said device comprising:

alignment structure having first and second board abutment surfaces in respective planes at said first included angle, said planes intersecting at a line to be aligned with said junction in use;

a fastener delivery channel, a plurality of triple-pronged fasteners positionable within said delivery channel, each said fastener having a first prong, a second prong parallel to the first prong, and a connecting portion that is perpendicular to said first and second prongs, said first and second prongs being generally aligned with said line, and said connecting portion being parallel to said line, said delivery channel ending at or near said line aligned with the junction of said first and second abutment surfaces so as to direct a first point of said first staple into said first board and a second point of said first staple into said second board, said delivery channel being fixed in position with respect to said alignment structure;

a first driver for driving said first and second prongs from said channel through said line into said boards, said driver being slidably connected to said alignment structure; and a second driver positioned at a first angle with respect to said first driver so as to travel generally parallel to said first abutment surface and to bend said third prong to change its orientation with respect to said first prong.

22. The driving system of claim 21, further comprising a third driver positioned at a second angle with respect to said first driver so as to travel generally parallel to said second abutment surface and to bend said third prong to change its orientation with respect to said first prong.

23. The driving system of claim 21, further comprising a first engagement button connected to said second driver, said engagement button connected to said alignment structure and capable of moving from a first position in which said second driver is not engaged to bend said third prong to a second position in which said second driver is engaged to bend said third prong.

24. The driving system of claim 21, further comprising a compressed fluid device for delivering driving forces to said first driver.

25. The driving system of claim 21, further comprising an explosive device for delivering driving forces to said first driver.

26. The driving system of claim 25 wherein said explosive device employs gunpowder.

* * * * *